US007673607B2

(12) United States Patent
Polt

(10) Patent No.: US 7,673,607 B2
(45) Date of Patent: Mar. 9, 2010

(54) TAPPET CARRIER FOR BARREL ENGINE

(75) Inventor: Anton Polt, Judendorf-Strassengel (AT)

(73) Assignee: Thomas Engine Company, LLC, Boulder, CO (US)

( * ) Notice: Subject to any disclaimer, the term of this patent is extended or adjusted under 35 U.S.C. 154(b) by 365 days.

(21) Appl. No.: 11/672,612

(22) Filed: Feb. 8, 2007

(65) Prior Publication Data

US 2007/0186891 A1 Aug. 16, 2007

Related U.S. Application Data

(60) Provisional application No. 60/773,109, filed on Feb. 14, 2006, provisional application No. 60/774,410, filed on Feb. 17, 2006.

(51) Int. Cl.
*F01L 1/14* (2006.01)

(52) U.S. Cl. ..... 123/90.48; 123/90.39; 123/90.44

(58) Field of Classification Search ..... 123/90.16, 123/90.39, 90.44, 90.48, 90.6, 90.27, 90.31
See application file for complete search history.

(56) References Cited

U.S. PATENT DOCUMENTS

| | | | | |
|---|---|---|---|---|
| 2,983,264 | A * | 5/1961 | Herrmann | 123/56.8 |
| 4,745,888 | A | 5/1988 | Kapp | |
| 5,094,195 | A | 3/1992 | Gonzalez | |
| 5,921,210 | A | 7/1999 | Regueiro | |
| 6,279,529 | B1 | 8/2001 | Komatsu et al. | |

* cited by examiner

*Primary Examiner*—Ching Chang
(74) *Attorney, Agent, or Firm*—Gifford, Krass, Sprinkle, Anderson & Citkowski, P.C.

(57) ABSTRACT

A tappet carrier for a barrel type internal combustion engine includes a body having a central bore that is coaxial with a camshaft of a barrel engine. The tappet carrier further comprises a plurality of radially extending bores that are continuous with the central bore so as to allow mechanical communication between the tappets and the camshaft.

20 Claims, 6 Drawing Sheets

TAPPET CARRIER FOR BARREL ENGINE

REFERENCE TO RELATED APPLICATIONS

This application claims priority to U.S. Provisional Patent Application Ser. Nos. 60/773,109, filed Feb. 14, 2006 and 60/774,410, filed Feb. 17, 2006, the entire content of both of which are incorporated herein by reference.

FIELD OF THE INVENTION

The invention relates to internal combustion engines. More particularly, the invention relates to a tappet carrier for use in a barrel type internal combustion engine.

BACKGROUND OF THE INVENTION

Internal combustion (IC) engines are widely used for providing mechanical power to drive a variety of devices. IC engines typically include a cylinder in which a fuel-air mixture is ignited, a piston movable in a reciprocating manner within the cylinder due to forces created by the ignition of the fuel-air mixture, and an output shaft driven by the reciprocating motion of the piston. IC engines also typically include a valve assembly for controlling the intake of fuel-air and exhaust of combustion products. The valve assembly is timed for appropriate intake and exhaust during intake compression powered exhaust strokes of the engine. Valve assemblies and the valve actuating mechanisms for barrel type internal combustion engines can be complicated or complex. It remains desirable to provide an improved structure for supporting the valve actuating mechanism and ensuring robust and reliable operation of the valve assembly.

SUMMARY OF THE INVENTION

According to one aspect of the invention, a tappet carrier is provided for a barrel type internal combustion engine. The tappet carrier includes a body having a central bore that is coaxial with a camshaft of a barrel engine. The tappet carrier further comprises a plurality of radially extending bores that are continuous with the central bore so as to allow mechanical communication between the tappets and the camshaft.

According to another aspect of the invention, a barrel internal combustion engine includes an engine block, a plurality of pistons, a shaft, a cam plate, a plurality of valves, a tappet carrier, a plurality of lobes and a plurality of tappets. The engine block has a plurality of cylinders. The plurality of pistons is slidably coupled to the plurality of cylinders for reciprocal movement along axes generally parallel with a central axis. The shaft is rotatably coupled to the engine block for rotation about the central axis. The cam plate is mechanically coupled to the shaft for rotation therewith. The cam plate is operatively coupled to the pistons to cause rotation of the shaft about the central axis in response to the reciprocal movement of the pistons. The plurality of valves controls the intake and exhaust of gases from the cylinders. The tappet carrier is adapted to be fixedly secured to the engine block. The tappet carrier has a central bore. The tappet carrier has a plurality of bores extending radially outwardly from the central bore. A plurality of lobes extends through the central bore and is mechanically coupled with the shaft for rotation therewith about the central axis. The plurality of tappets is operative for actuating the plurality of valves. The tappets are slidably supported in respective bores of the tappet carrier to cause actuation of the valves in response to rotation of the lobes about the central axis.

According to another aspect of the invention, a barrel engine includes first and second tappets. The first set of tappets extends along respective first axes. The second set of tappets extends along respective second axes. The first and second axes are nonparallel relative to each other.

According to another aspect of the invention, a tappet carrier is provided for supporting tappets of a barrel type internal combustion engine. The tappet carrier includes a main body having a central bore for rotatably supporting a camshaft therein. The main body has first and second sets of bores for slidably supporting the tappets. The first and second sets of bores extend radially outwardly from the central bore allowing mechanical communication between the tappets and the camshaft. The first and second sets of bores are nonparallel relative to each other.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE INVENTION

Figure 1:
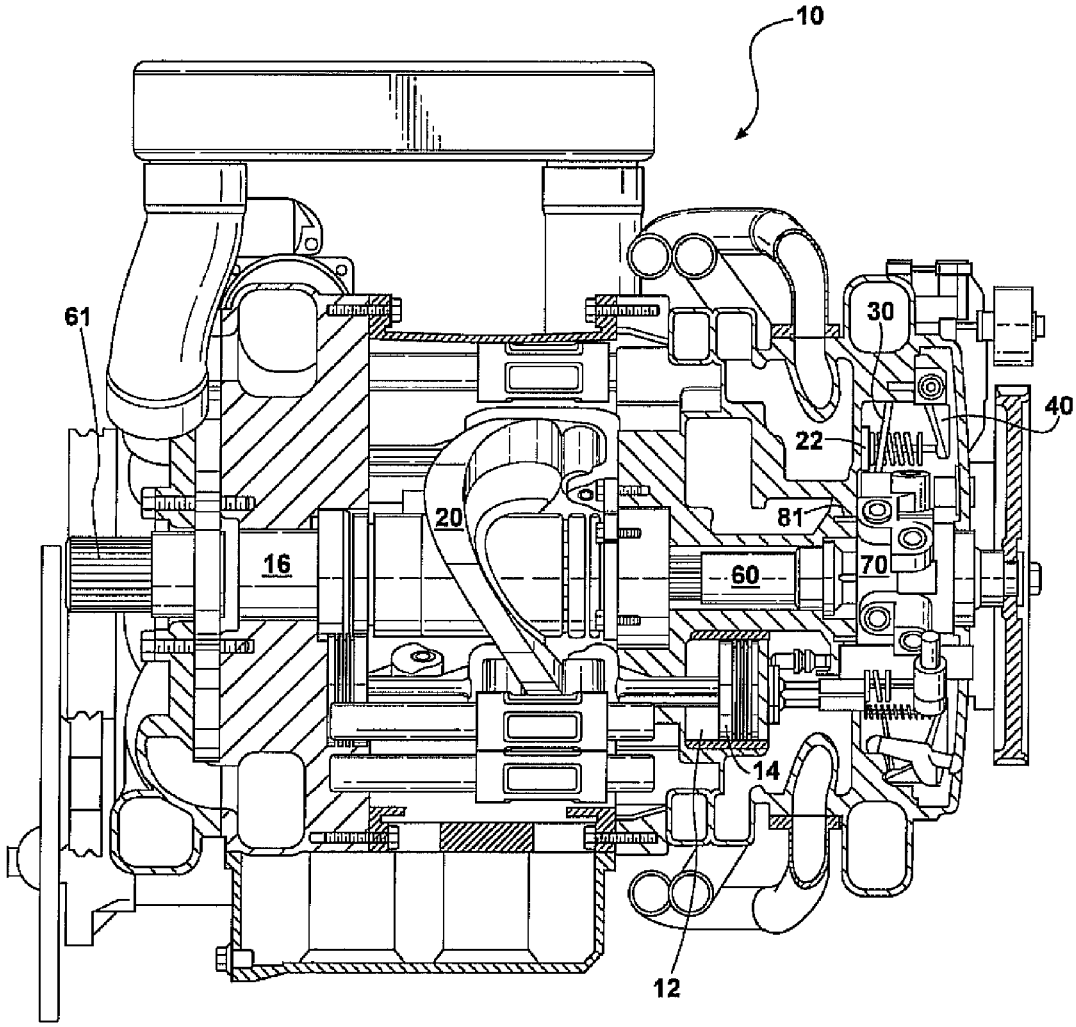
FIG. 1 is a fragmentary side view of a barrel type internal combustion engine according to one embodiment of the invention.

Referring to FIG. 1, a barrel type internal combustion engine 10 according to the invention is generally indicated at 10. The engine 10 includes a plurality of cylinders 12 and pistons 14 arranged concentrically about a central driveshaft assembly 16. The pistons 14 are slidably engaged with the respective cylinders 12 for reciprocal axial movement therein. Power is transmitted from the reciprocating pistons 14 to a cam plate 20 via a roller or bearing interface, and the cam plate 20 is coupled to the shaft assembly 16 for rotation therewith about the longitudinal axis of the shaft assembly 16. The cam plate 20 has a generally sinusoidal shape such that the reciprocal axial movement of the pistons 14 causes corresponding rotational movement of the cam plate 20 and shaft assembly 16.

Figure 2:
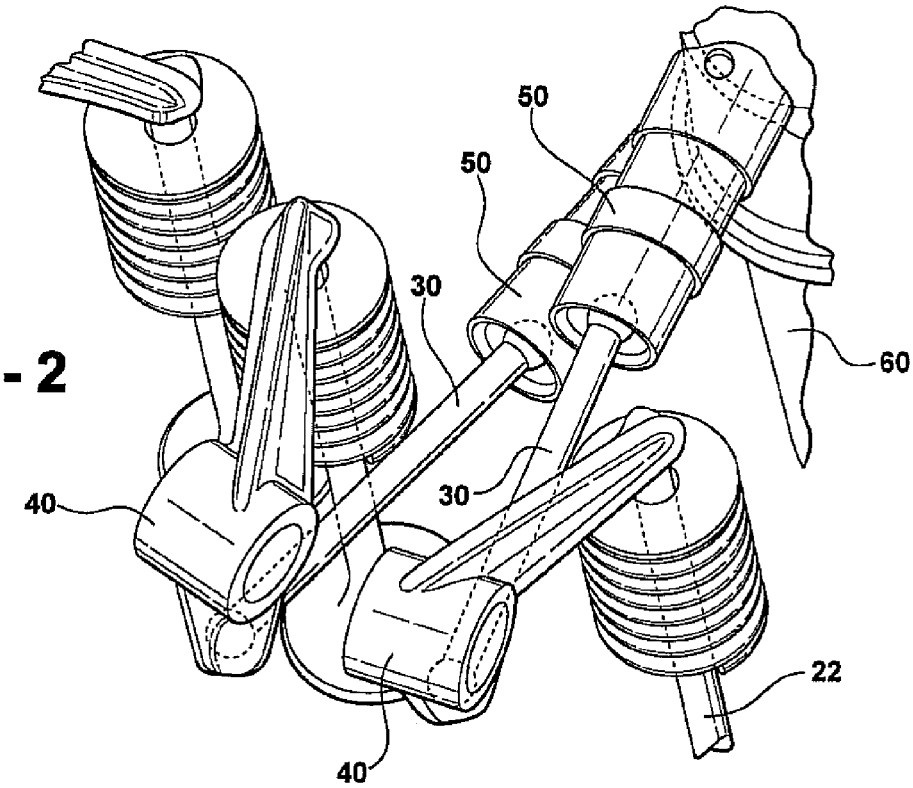
FIG. 2 is an enlarged partial perspective view of the rocker arm and tappet portion of the engine.
Figure 3:
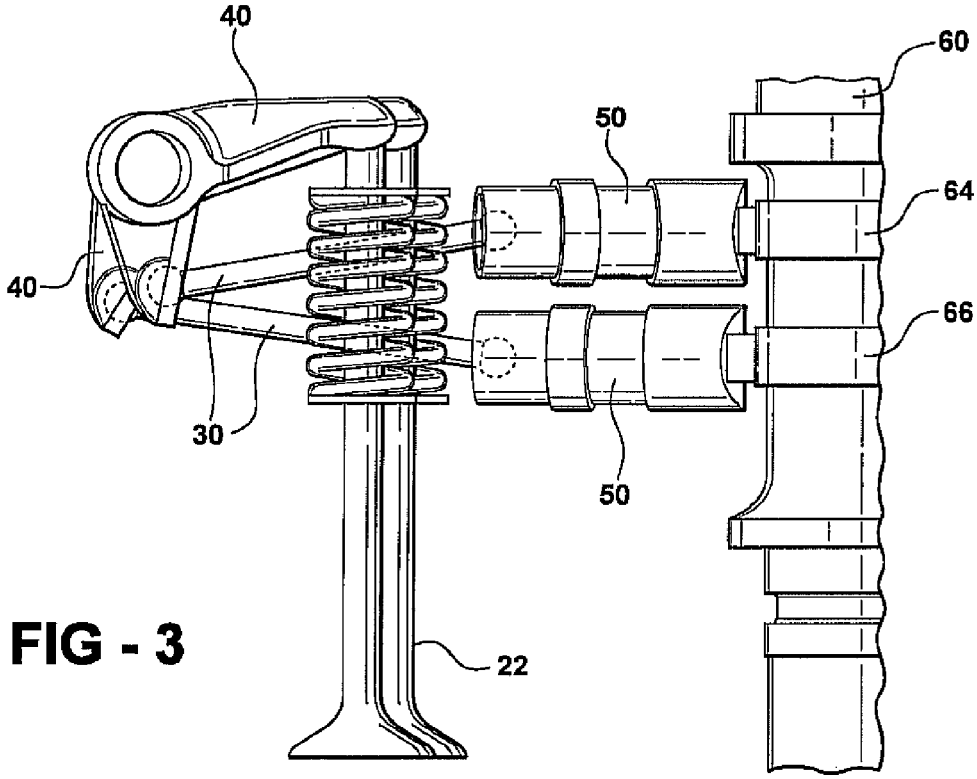
FIG. 3 is a side elevational view of the rocker arm and tappet portion of the engine.
Figure 4:
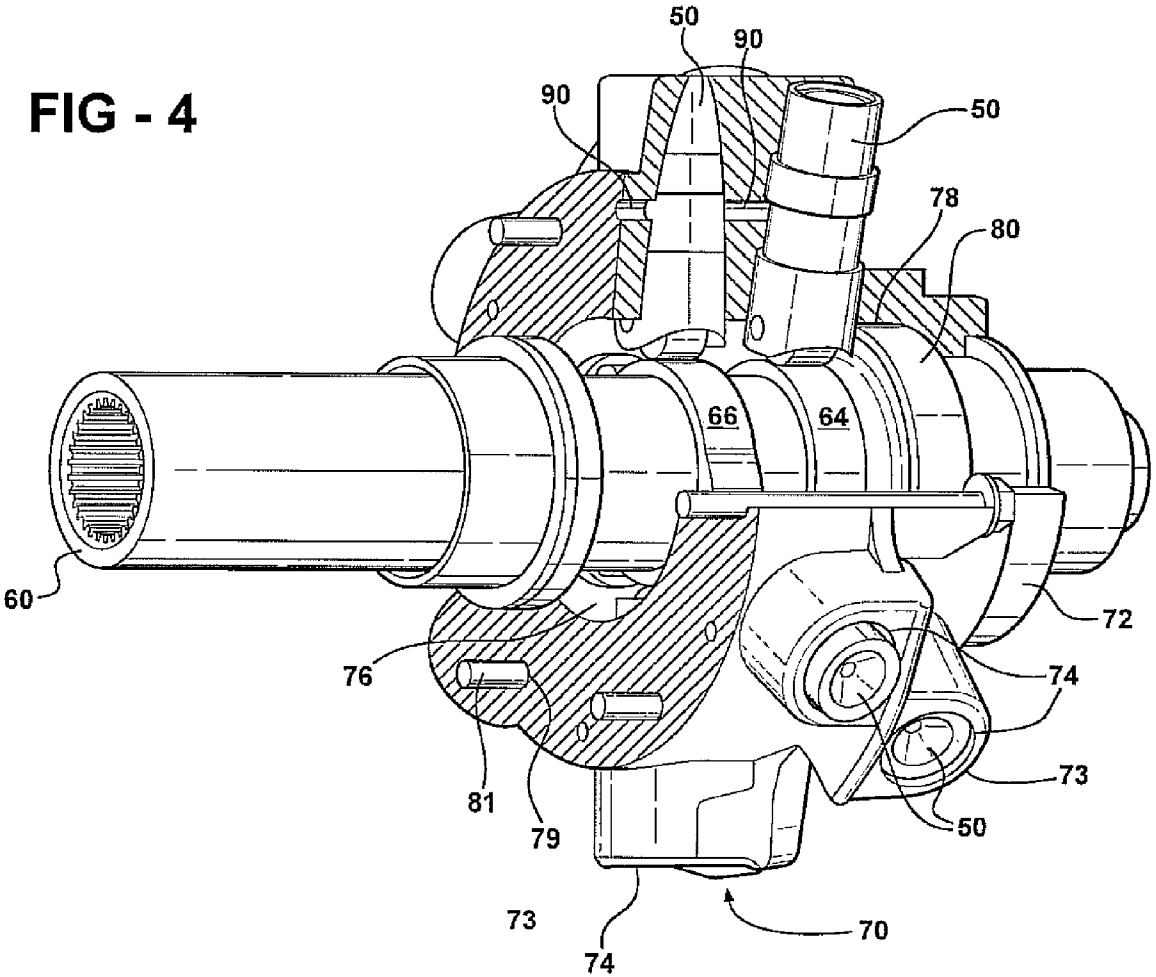
FIG. 4 is a perspective view of the assembly of a camshaft, a tappet carrier and the tappets.

Referring to FIGS. 1-3, the engine 10 also includes a valve assembly for controlling the intake and exhaust of gases from the cylinders 12. The valves 22 of the valve assembly are actuated by pivotal movement of respective rocker arms 40. The rocker arms 40 are generally L-shaped in the illustrated embodiment. The rocker arms 40 are actuated by displacement of respective tappets 50 via pushrods 30. The tappets 50 having ends rollingly engaged with cams 64, 66 extending eccentrically from a camshaft 60. The camshaft 60 in turn is coupled coaxially with the driveshaft 61 of the barrel engine 10 for rotation therewith.

The camshaft 60 includes an intake cam lobe 64 and an exhaust cam lobe 66. The lobes 64, 66 are eccentric with respect to the drive axis such that rotation of the camshaft 60 about the drive axis will cause a reciprocal displacement of the tappets 50. The reciprocal movement of the tappets 50 is transferred by respective intake and exhaust pushrods 30. The pushrods 30 cause pivotal movement of the L-shaped rocker arms 40, in turn causing displacement of the valves 22.

As will be clear to those of skill in the art, the illustrated valve assembly may be altered in various ways. For example, the roller tappets 50 may include hydraulic lash compensation or may be mechanical. Alternatively, hydraulic or mechanical non-roller tappets may be substituted with appropriate alternations in the overall system. Further, the pushrod configuration may be altered, including providing a system wherein the tappets directly actuate the rocker arms without the use of pushrods. The L-shaped rocker arms may take other forms, such as having other shapes, or being inverted as shown in co-pending PCT No. PCT/US2006/024591, which is incorporated herein by reference.

Referring now to FIGS. 4-7, a tappet carrier is generally indicated at 70. The tappet carrier 70 includes a generally cylindrically shaped body 72. The body 72 includes a center bore 76. When the engine is assembled, the camshaft 60 extends axially through the center bore 76 of the tappet carrier body 72. The body 72 of the tappet carrier 70 also includes a plurality of radially extending arms 73. The arms 73 include radially outwardly extending bores 74 defined therethrough for receiving and slidably supporting the tappets 50 therein. The radially extending bores 74 are continuous with the center bore 76 so as to allow mechanical communication between the tappets 50 and the cam lobes 64, 66 of the camshaft 60. The body 72 may also include a bearing surface 78 for supporting an end of the camshaft 60. A roller or plain bearing is provided between the bearing surface 78 of the tappet carrier 70 and a corresponding surface 80 of the camshaft 60. Oil feed lines 90 are preferably also provided throughout the tappet carrier 70 for providing oil to the tappets, for hydraulic lash adjustment, and to lubricate the walls defining the radially extending bores 74. The tappet carrier 70 also includes a plurality of holes 79 allowing bolts 81 to extend therethrough for assembly of the tappet carrier 70 to the engine block 10. Optionally, the tappet carrier 70 includes a reinforcement web or wall 99 that provides reinforcement between the body 72 and each arm 73.

Figure 5:
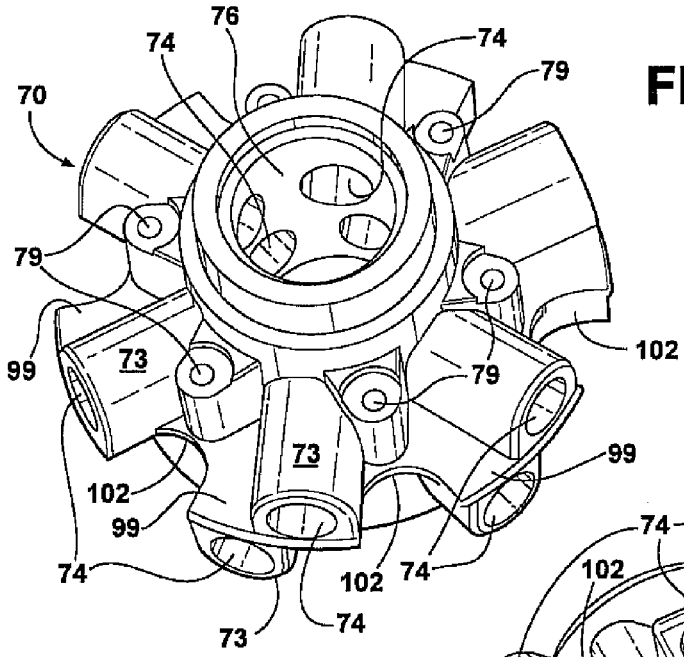
FIGS. 5-7 are perspective views of the tappet carrier.
Figure 6:
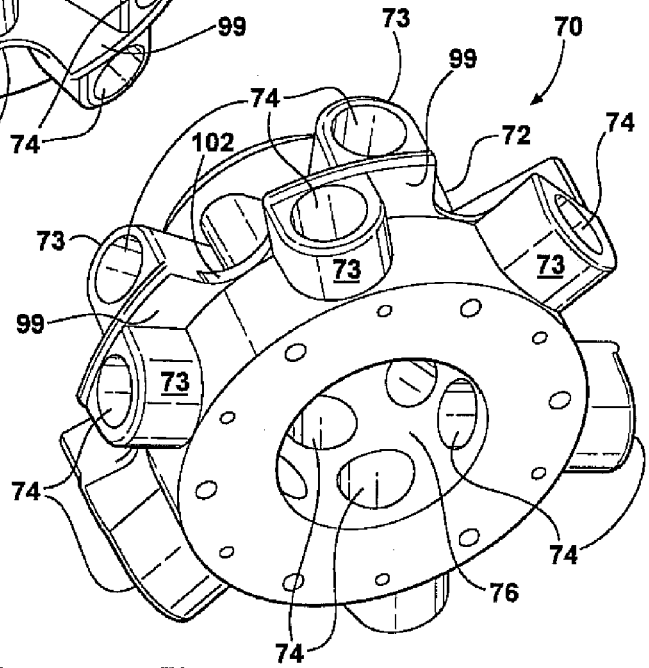
Figure 7:
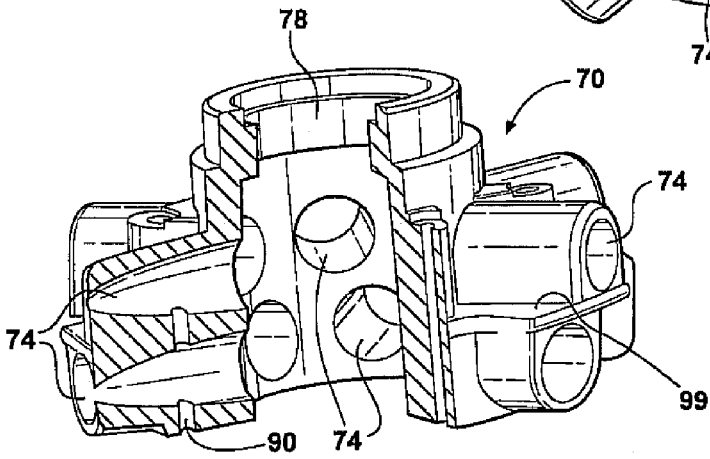

Perspective views of the tappet carrier 70 are provided in FIGS. 5-7. In one embodiment of the invention the entire tappet carrier 70 may formed as one piece in a casting and/or milling process. While casting allows formation of the overall or general shape of the tappet carrier 70, it is appreciated that additional milling and finishing may be necessary before the carrier 70 is ready for use.

Figure 8:
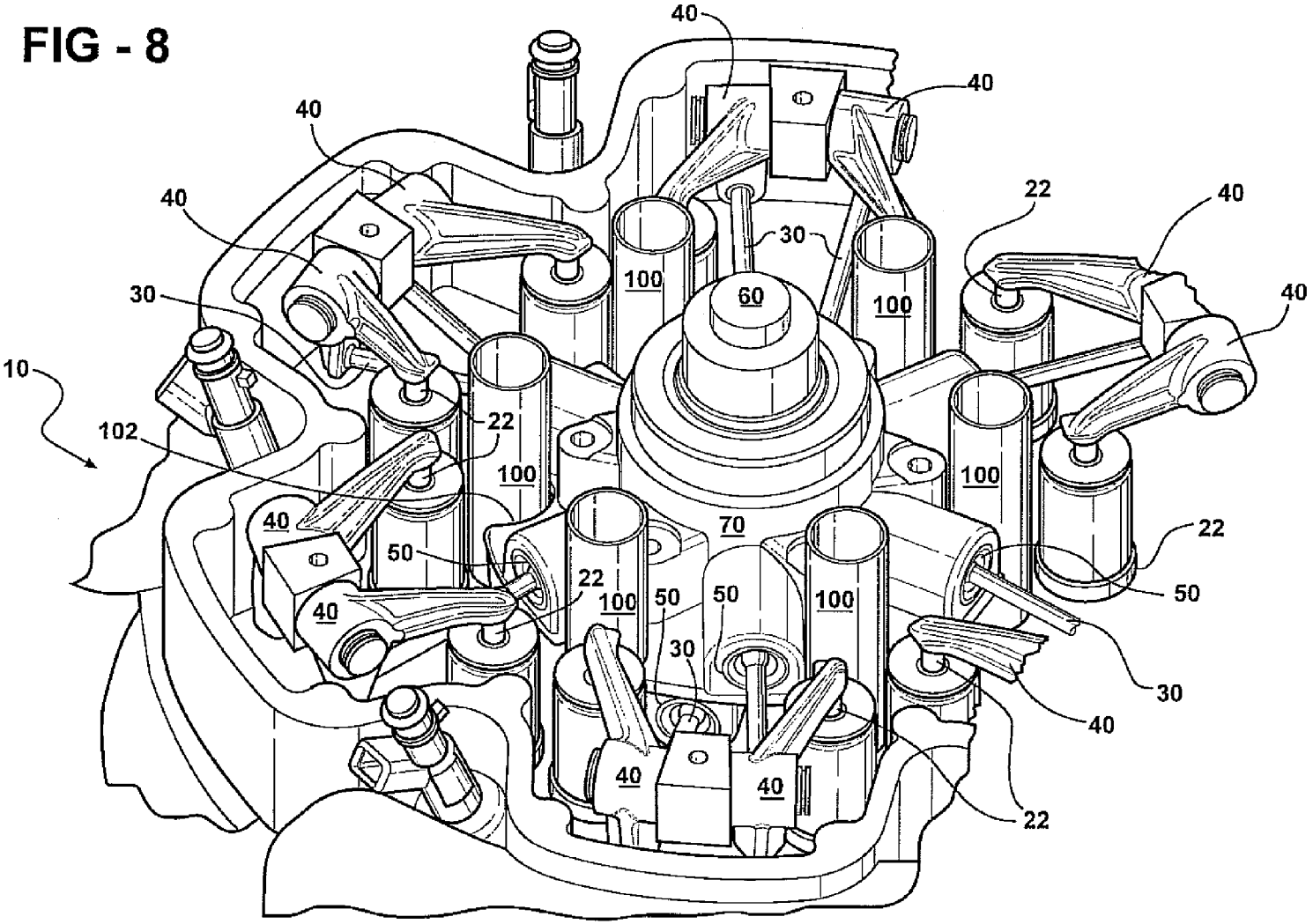
FIG. 8 is an enlarged perspective view of the tappet carrier, tappets, and rockers assembled to the engine.

Referring to FIG. 8, the tappets are supported in the carrier 70 and generally grouped in adjacent pairs 50, 50'. The pairs of tappets 50, 50' are offset relative to the cylinders, such that both tappets 50, 50' of each pair actuate valves of respective adjacent cylinders. For example, one tappet 50 may actuate the valve of one cylinder, while the other tappet 50' in the pair may actuate the valve of an adjacent cylinder.

Figure 9:
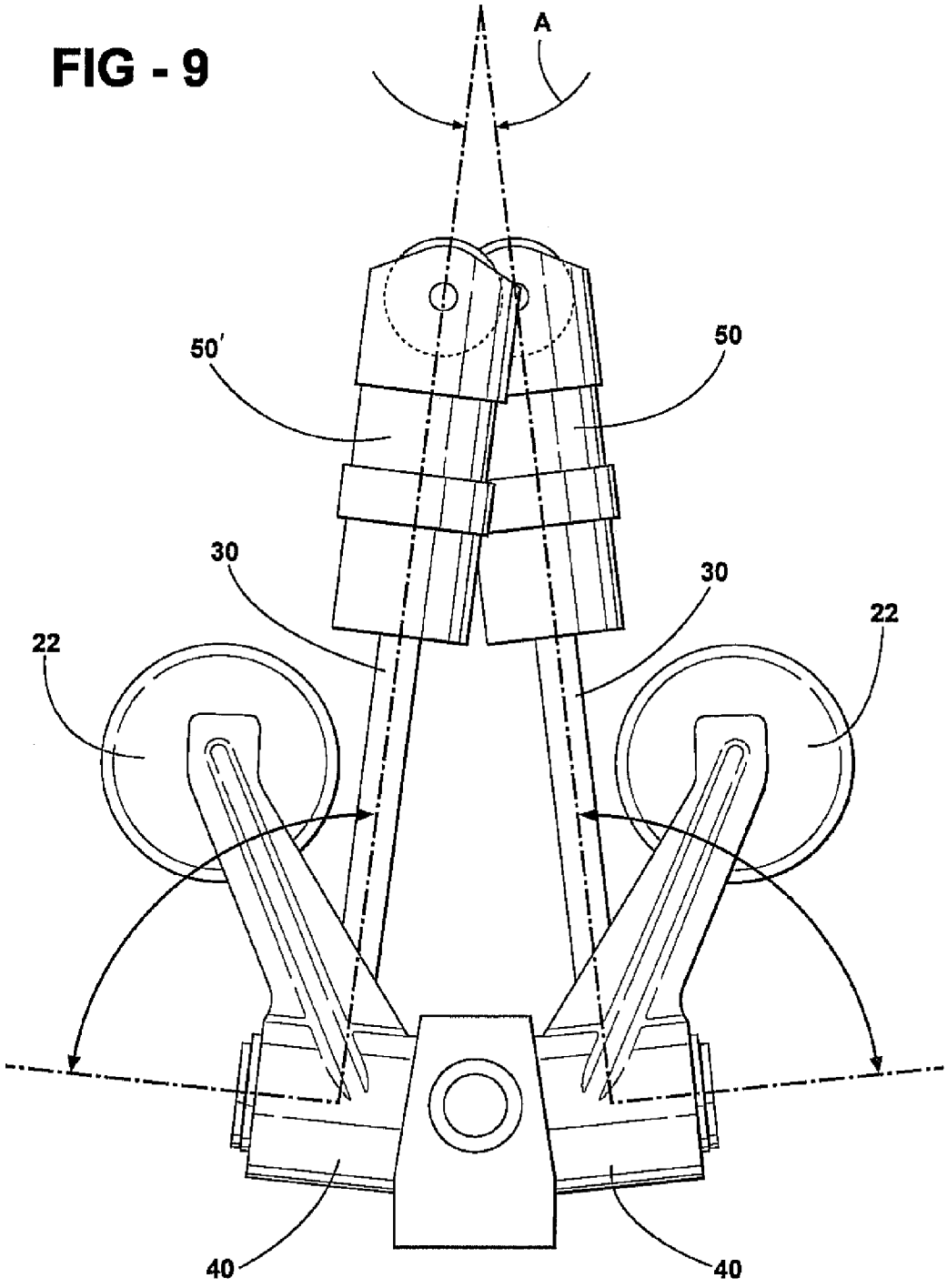
FIG. 9 is a partial top elevational view of the tappets, rocker arms and valves.

As best shown in FIGS. 3 and 9, the tappets 50, 50' of each pair are nonplanar or spaced apart in the direction of the camshaft 60 axes. As shown in the top view of FIG. 9, the tappets 50, 50' of each pair are overlapped in a nonparallel or angled manner relative to each other to minimize spacing and allow the design and use of a compact engine block design, and to facilitate access to the spark plugs. In the illustrated embodiment, the angle A (in a plane orthogonal to the axis of the cam shaft) between a pair of tappets is approximately 15 degrees, with a range of 5 to 25 degrees being preferred. As will be clear to those of skill in the art, if the tappets 50 and 50' were to be positioned directly on top of each other, such as parallel, they would need to be spaced apart a greater distance in the direction of the camshaft axes in order to provide a similar amount of supporting material around the bores 74. This would likely lead to the carrier body 72 being longer in the direction of the camshaft axes. As best shown in FIGS. 5, 6 and 8, the close spacing between adjacent tappets 50 and 50' provides a gap between each pair. In the embodiment illustrated in FIG. 8, spark plug tubes 100 are shown extending thru these gaps. In the illustrated embodiment, the reinforcement wall 99 has cutouts or recesses 102 provided between adjacent groups of tappets to allow clearance for the spark plug tubes 100. These clearance areas may also be useful in other configurations where the spark plugs or spark plug tubes are positioned differently than illustrated. The close positioning of the tappets 50 and 50' may also provide a more direct load path on the push rods 30, thereby reducing the side load on the tappets.

The invention has been described in an illustrative manner and it is therefore to be understood that the terminology used is intended to be in the nature of words of description rather than of limitation. Many modifications and variations of the invention are possible in light of the above teachings. Thus, within the scope of the appended claims the invention may be practiced other than as specifically described.

I claim:

1. A tappet carrier for supporting tappets of a barrel type internal combustion engine, wherein the engine includes an engine block and a cam shaft rotatably supported by the engine block, said tappet carrier comprising:

a body separate from and attachable to the engine block, the body having a central bore for receiving a portion of the cam shaft therethrough, the central bore defining a central axis, the tappet carrier further comprising a plurality of tappet bores extending from and continuous with the central bore to allow mechanical engagement between the tappets and the camshaft, the tappet bores extending radially with respect to the central axis.

2. A tappet carrier as set forth in claim 1, wherein the body includes a plurality of radially outwardly extending arms, one of the radially extending tappet bores being defined in each of the radially outwardly extending arms.

3. A tappet carrier as set forth in claim 2, wherein each arm includes an oil path in fluid communication with the tappet bore for lubricating each tappet.

4. A tappet carrier as set forth in claim 1, wherein the body includes a bearing surface for supporting a camshaft bearing.

5. A tappet carrier as set forth in claim 1, wherein the plurality of radially extending tappet bores includes a first set disposed generally in a first plane and a second set disposed generally in a second plane, each plane being generally orthogonal relative to the central axis.

6. A tappet carrier as set forth in claim 5, wherein the plurality of radially extending tappet bores are disposed in pairs, the tappet bores in each pair being spaced apart by a first distance, each pair being spaced apart from other pairs by a second distance greater than the first distance.

7. A tappet carrier as set forth in claim 6, wherein each tappet bore has a central axis, an angle being defined between the axes of the tappet bores in each pair, the angle being in the range of 5 degrees to 25 degrees.

8. A tappet carrier as set forth in claim 7, wherein the angle is approximately 15 degrees.

9. A tappet carrier as set forth in claim 6, wherein clearance recesses are defined in the tappet body in the second distance between the pairs of tappet bores.

10. A barrel internal combustion engine comprising:

an engine block having a plurality of cylinders;

a plurality of pistons slidably coupled to the plurality of cylinders for reciprocal movement along axes generally parallel with a central axis;

a shaft rotatably coupled to the engine block for rotation about the central axis;

a cam plate mechanically coupled to the shaft for rotation therewith, the cam plate being operatively coupled to the pistons to cause rotation of the shaft about the central axis in response to the reciprocal movement of the pistons;

a plurality of valves for controlling the intake and exhaust of gases from the cylinders;

a tappet carrier separate from and attachable to the engine block, the tappet carrier having a central bore coaxial with the central axis, the tappet carrier having a plurality of tappet bores extending from and continuous with the central bore, the tappet bores extending radially with respect to the central axis;

a plurality of lobes extending through the central bore and mechanically coupled with the shaft for rotation therewith about the central axis;

a plurality of tappets operative for actuating the plurality of valves, the tappets being slidably supported in respective tappet bores of the tappet earner to cause actuation of the valves in response to rotation of the lobes about the central axis.

11. A barrel internal combustion engine as set forth in claim 10, wherein the tappet carrier includes a plurality of radially outwardly extending arms, one of the radially extending tappet bores being defined in each of the radially outwardly extending arms.

12. A barrel internal combustion engine as set forth in claim 11, wherein each arm includes an oil path in fluid communication with the tappet bore for lubricating each tappet.

13. A barrel internal combustion engine as set forth in claim 10, wherein the tappet cater includes a bearing surface for supporting a camshaft bearing.

14. A barrel internal combustion engine as set forth in claim 10, wherein the plurality of radially extending tappet bores in the tappet carrier includes a first set disposed generally in a first plane and a second set disposed generally in a second plane, each plane being generally orthogonal relative to the central axis.

15. A barrel internal combustion engine as set forth in claim 14, wherein the plurality of radially extending tappet bores are disposed in pairs, the tappet bores in each pair being spaced apart by a first distance, each pair being spaced apart from other pairs by a second distance greater than the first distance.

16. A barrel internal combustion engine as set forth in claim 15, wherein each tappet bore has a central axis, an angle being defined between the axes of the tappet bores in each pair, the angle being in the range of 5 degrees to 25 degrees.

17. A barrel internal combustion engine as set forth in claim 16, wherein the angle is approximately 15 degrees.

18. A barrel internal combustion engine as set forth in claim 15, wherein clearance recesses are defined in the tappet carrier in the second distance between the pairs of tappet bores, the engine further including spark plug tubes received in each of the clearance recesses.

19. A tappet carrier for supporting tappets of a barrel type internal combustion engine, said tappet carrier comprising:

a main body having a central bore for rotatably supporting a camshaft therein, the central bore defining a central axis, the main body having first and second sets of tappet bores for slidably supporting the tappets, the first and second sets of tappet bores being continuous with and extending from the central bore, thereby allowing mechanical communication between the tappets and the camshaft, the tappet bores extending radially outwardly with respect to the central axis, each of the tappet bores having an axis, the axis of each tappet bore in the first set being nonparallel relative to the axes of the tappet bores in the second set.

20. A tappet carrier as set forth in claim 19, wherein the axes of tappet bores in the first set are disposed in a first plane generally orthogonal to the central axis and the axes of the tappet bores in the second set are disposed in a second plane generally parallel and spaced apart from the first plane.

* * * * *

UNITED STATES PATENT AND TRADEMARK OFFICE

CERTIFICATE OF CORRECTION

PATENT NO. : 7,673,607 B2
APPLICATION NO. : 11/672612
DATED : March 9, 2010
INVENTOR(S) : Anton Polt It is certified that error appears in the above-identified patent and that said Letters Patent is hereby corrected as shown below:

Col, 5, line 28: delete "earner" and replace with --carrier--

Col. 5, line 38: delete "cater" and replace with --carrier--

Signed and Sealed this

Twenty-eighth Day of September, 2010

David J. Kappos

David J. Kappos
*Director of the United States Patent and Trademark Office*